US008335441B2

(12) United States Patent
Kubo et al.

(10) Patent No.: US 8,335,441 B2
(45) Date of Patent: Dec. 18, 2012

(54) IMAGE FORMING APPARATUS AND IMAGE FORMING METHOD

(75) Inventors: Hideki Kubo, Kawasaki (JP); Jun Hirabayashi, Yokohama (JP); Megumi Ito, Tokyo (JP); Sumito Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/046,020

(22) Filed: Mar. 11, 2011

(65) Prior Publication Data

US 2011/0164888 A1 Jul. 7, 2011

Related U.S. Application Data

(63) Continuation of application No. PCT/JP2009/004638, filed on Sep. 16, 2009.

(30) Foreign Application Priority Data

Sep. 25, 2008 (JP) ..... 2008-246593
Sep. 9, 2009 (JP) ..... 2009-208601

(51) Int. Cl.
*G03G 15/08* (2006.01)
*G03G 15/00* (2006.01)

(52) U.S. Cl. ..... 399/27; 399/46; 399/49; 399/258

(58) Field of Classification Search ..... 399/27, 399/30, 46, 49, 254, 258
See application file for complete search history.

(56) References Cited

U.S. PATENT DOCUMENTS 4,370,053 A 1/1983 Hirayama et al.
4,422,749 A 12/1983 Hoshino et al.
5,812,903 A * 9/1998 Yamada et al. ..... 399/49 X
5,950,043 A * 9/1999 Fujita et al. ..... 399/49 X
6,055,388 A * 4/2000 Watanabe et al. ..... 399/58
6,173,144 B1 1/2001 Hirabayashi et al.
6,418,281 B1 7/2002 Ohki
6,668,143 B2 12/2003 Ito
7,010,237 B2 * 3/2006 Suzuki et al. ..... 399/27
(Continued)

FOREIGN PATENT DOCUMENTS

JP 5-303280 A 11/1993
(Continued)

OTHER PUBLICATIONS

Office Action dated Aug. 20, 2012, in Korean Application No. 10-2011-7008599.

*Primary Examiner* — Sandra Brase
(74) *Attorney, Agent, or Firm* — Fitzpatrick, Cella, Harper & Scinto

(57) ABSTRACT

This invention is to provide a technique of always obtaining a stable output image in image formation using toner. A supplier (1217) supplies toner in a decided toner supply amount. A developing device (1206) agitates the supplied toner and supplies the agitated toner to an electrostatic latent image formed on a photosensitive drum (1203), thereby developing a toner image on the photosensitive drum (1203). A correction amount calculation unit (1106) estimates the toner charge amount by calculating a function model that approximates the variation characteristic of the toner charge amount using the toner consumption necessary for printing a print target image, the toner supply amount necessary for printing the print target image, and the toner agitation time. At least one of an image processing condition and a process condition is controlled using the estimated toner charge amount.

5 Claims, 14 Drawing Sheets

U.S. PATENT DOCUMENTS

| | | | | |
|---|---|---|---|---|
| 7,426,360 | B2 | 9/2008 | Arimoto et al. | |
| 2007/0274740 | A1 * | 11/2007 | Katoh et al. | 399/254 |

FOREIGN PATENT DOCUMENTS

| | | | |
|---|---|---|---|
| JP | 6-130768 | A | 5/1994 |
| JP | 11-212343 | A | 8/1999 |
| JP | 2000-238341 | A | 9/2000 |
| JP | 2001-42613 | A | 2/2001 |
| JP | 2004-198805 | A | 7/2004 |
| JP | 2006-301297 | A | 11/2006 |
| JP | 2008-145982 | A | 6/2008 |
| JP | 2008-191188 | A | 8/2008 |

* cited by examiner

IMAGE FORMING APPARATUS AND IMAGE FORMING METHOD

This application is a continuation of International Application No. PCT/JP2009/004638, filed Sep. 16, 2009, which claims the benefit of Japanese Patent Application No. 2008-246593, filed Sep. 25, 2008 and Japanese Patent Application No. 2009-208601, filed Sep. 9, 2009.

TECHNICAL FIELD

The present invention relates to a technique of forming an image using electrophotography.

BACKGROUND ART

A developing device provided in an electrophotographic or electrostatic recording type image forming apparatus generally uses a two-component developer mainly containing toner particles and carrier particles. In particular, in color image forming apparatuses for forming a full-color image or a multi-color image, most developing devices use the two-component developer. The toner density (that is, the ratio of the weight of the toner particles to the total weight of the carrier particles and toner particles) of the two-component developer is a very important factor for image quality stabilization.

Upon development, the toner particles of the two-component developer are consumed, and the toner density changes. For this reason, a technique (PTL1) has been disclosed which detects the toner density of a two-component developer in a developing device and controls toner supply to the developing device in accordance with the detected toner density, thereby controlling the two-component developer to maintain predetermined toner density.

However, the above-described method cannot always output an image at a desired density. One major reason for this is a variation in the toner charge amount. The toner charge amount is one of the important factors for image quality stabilization. Electrophotography or electrostatic recording forms an image using the electrostatic force. For this reason, a variation in the toner charge amount leads to a variation in the image density.

Known causes of the variation in toner charge amount are temperature and humidity in the environment where the image forming apparatus is installed and aging degradation of the carrier caused by long-term use. Another main cause is a change in toner consumption on images.

FIG. 10 is a graph showing an example of a change in the toner charge amount caused by agitation. Leaving toner to stand for a long time causes frictional electrification as the toner is agitated and rubs against the carrier in the developing device. An example of the change in the toner charge amount corresponding to toner consumption when 20 document pages are printed will be described with reference to FIGS. 11A to 11C.

FIG. 11A is a graph showing the toner consumption of each printed sheet in the example to be described based on FIGS. 11A to 11C. The toner consumption of each sheet is 2T (mg) when printing the first to 10th pages and T (mg) when printing the 11th to 20th pages. FIG. 11B is a graph showing the toner supply amount for each sheet. The toner is supplied in the same amount as the consumed amount in development. FIG. 11C is a graph showing the toner charge amount at the start of printing of each sheet under the circumstances illustrated in FIGS. 11A and 11B.

Before submitting a print job, the toner is sufficiently agitated, and the toner charge amount is 30Q (μC/g). When the print job is executed, new toner that is not sufficiently frictionally electrified is supplied to the developing device. The toner charge amount gradually decreases because frictional electrification by agitation in the developing device cannot keep up. The toner charge amount thus converges to almost 23Q (μC/g). From the 10th page where the toner consumption and supplied toner amount decrease, the balance between the supplied toner and the toner remaining in the developing device changes, and the toner charge amount gradually increases and converges to almost 27Q (μC/g).

As described above, even when the conditions of the toner density and output environment are controlled to predetermined levels, the toner charge amount may change between output images. Since the image density also changes with variation in the toner charge amount, it may be impossible to output a document at a desired density. To solve this, a method is used which detects the density of a developed image and supplies toner if the density is lower than a desired value. There is also a method of correcting the grayscale of an image signal instead of controlling toner supply (PTL2).

CITATION LIST

Patent Literature

PTL1: Japanese Patent Laid-Open No. 5-303280
PTL2: Japanese Patent Laid-Open No. 2000-238341
PTL3: Japanese Patent Laid-Open No. 06-130768

SUMMARY OF INVENTION

Technical Problem

As is apparent from FIGS. 11B and 11C, it takes time to recover the toner charge amount after toner supply. That is, it takes time until toner supply begins to affect the actual image density. Hence, the method of detecting the density of a developed image and then supplying toner cannot be used to obtain the desired density for an image output during a time corresponding to the delay.

In addition, both the method of detecting the density of a developed image and the method of PTL2 need to create patches for density detection and then detect the density. For this reason, the higher the correction frequency is, the lower the productivity is.

The present invention has been made in consideration of the above-described problems, and its objective is to provide a technique of consistently obtaining a stable output image in image formation using toner.

Solution to Problem

In order to achieve the objective of the present invention, for example, an image forming apparatus of the present invention has the following arrangement. That is, there is provided an image forming apparatus including:

an image processing unit adapted to perform image processing of an image signal using an image processing condition; and an image forming unit adapted to form an image by electrophotography using a controlled process condition based on the image signal that has undergone the image processing, comprising:

a supply unit adapted to supply toner to a developing unit based on a designated toner supply amount;

said developing unit adapted to develop an electrostatic latent image formed on a photosensitive drum after agitating the supplied toner;

a toner consumption prediction unit adapted to predict, based on image data representing an image, a toner consumption necessary for outputting the image;

a toner supply amount decision unit adapted to decide the toner supply amount based on an image signal representing the image;

an acquisition unit adapted to acquire a time of toner agitation by said developing unit; and a control unit adapted to control at least one of the image processing condition and the process condition by estimating a toner charge amount using the predicted toner consumption, the toner supply amount, and the agitation time.

In order to achieve the objective of the present invention, for example, an image forming method of the present invention has the following arrangement. That is, there is provided an image forming method used by an image forming apparatus including an image processing unit which performs image processing of an image signal using an image processing condition, and an image forming unit which forms an output image by electrophotography using a controlled process condition based on the image signal that has undergone the image processing, comprising:

the supply step of supplying toner to a developing unit based on a designated toner supply amount;

the developing step of developing an electrostatic latent image formed on a photosensitive drum after agitating the supplied toner;

the toner consumption prediction step of predicting, based on image data representing an image, a toner consumption necessary for outputting the image;

the toner supply amount decision step of deciding the toner supply amount based on an image signal representing the image;

the acquisition step of acquiring a time of toner agitation by the developing unit; and the control step of controlling at least one of the image processing condition and the process condition by estimating a toner charge amount using the predicted toner consumption, the toner supply amount, and the agitation time.

ADVANTAGEOUS EFFECTS OF INVENTION

According to the arrangement of the present invention, it is possible to consistently obtain a stable output image in image formation using toner.

Other features and advantages of the present invention will be apparent from the following descriptions taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

DESCRIPTION OF EMBODIMENTS

[First Embodiment]

Figure 1:
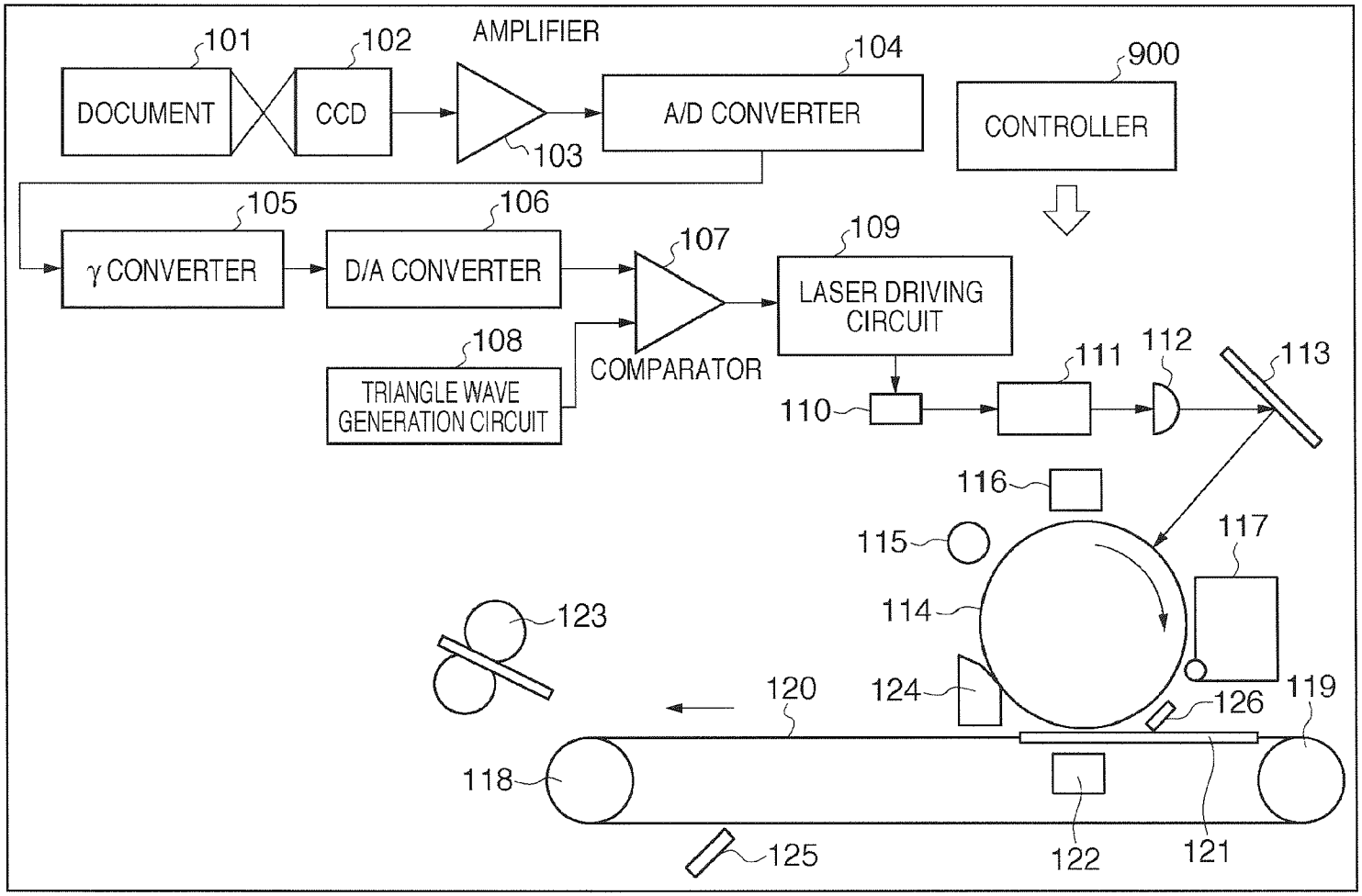
FIG. 1 is a block diagram showing an example of the arrangement of a digital multi function peripheral according to the first embodiment.

An image forming apparatus according to this embodiment forms an electrostatic latent image on an image carrier such as a photosensitive member or dielectric by electrophotography, electrostatic recording, or the like, and causes a developing device entailing a developer supply to develop the electrostatic latent image, thereby forming a visible image. This embodiment is therefore applicable to any other image forming apparatus having the same or similar arrangement. FIG. 1 is a block diagram showing an example of the arrangement of an electrophotographic digital multi function peripheral that is an example of the image forming apparatus according to this embodiment.

A CCD 102 reads a document 101 as an image via an imaging lens (not shown). The CCD 102 divides the read image into a number of pixels and generates photoelectric conversion signals (analog signals) corresponding to the densities of the pixels. The generated analog image signal of each pixel is amplified to a predetermined level by an amplifier 103 and converted into, for example, an 8-bit (255-tone level) digital image signal by an analog/digital converter (A/D converter) 104.

Next, the digital image signal is supplied to a γ converter 105 (here, a converter for converting the density using a lookup table including 256-byte data). The γ converter 105 performs γ correction for the digital image signal. The digital image signal that has undergone the γ correction is input to a digital/analog converter (D/A converter) 106.

The D/A converter 106 performs D/A conversion of the digital image signal to convert it into an analog image signal. The D/A converter 106 outputs the converted analog image signal. The analog image signal is supplied to one input terminal of a comparator 107.

The comparator 107 receives, at the other input terminal, a triangle wave signal having a predetermined period supplied from a triangle wave generation circuit 108, and compares the analog image signal with the triangle wave signal so as to pulse-width-modulate the image signal. The binary image signal as the pulse width modulation result is input to a laser driving circuit 109. The laser driving circuit 109 on/off-controls light emission of a laser diode 110 based on the binary image signal.

A laser beam emitted by the laser diode 110 is scanned by a known polygon mirror 111 in the main scanning direction, passes through an fe lens 112 and a reflecting mirror 113, and irradiates the surface of a photosensitive drum 114 that is an image carrier rotating in the direction of an arrow.

The photosensitive drum 114 is uniformly discharged by an exposure device 115 and then uniformly charged to, for example, a negative potential by a primary charger 116. After that, an electrostatic latent image is formed on the photosensitive drum 114 irradiated with the laser beam.

A developing device 117 develops the electrostatic latent image to a visible image (toner image). At this time, a DC bias component corresponding to the electrostatic latent image forming condition and an AC bias component for improving the developing efficiency are superimposed and applied to the developing device 117.

The toner image is transferred by the function of a transfer charger 122 onto a transfer medium 121 held on a belt-like transfer medium carrier (transfer belt) 120 that loops over two rollers 118 and 119 and is endlessly driven in the direction of an arrow. The transfer medium 121 with the transferred toner image is conveyed to a fixing device 123. The fixing device 123 fixes the toner image on the transfer medium 121 to the transfer medium 121. The transfer medium 121 with the fixed toner image is discharged.

The residual toner remaining on the photosensitive drum 114 is scraped off by a cleaner 124 and collected. The residual toner still remaining on the transfer belt 120 after separating the transfer medium 121 is scraped off by a cleaner 125 such as a blade installed downstream from the position where the transfer medium 121 is transferred to the fixing device 123 around the transfer belt 120.

Note that FIG. 1 illustrates only a single image forming station (including the photosensitive drum 114, exposure device 115, primary charger 116, developing device 117, and the like) for convenience of description. For color image formation, however, image forming stations corresponding to, for example, cyan, magenta, yellow, and black are sequentially arrayed on the transfer belt 120 along its moving direction. Alternatively, the developing devices 117 of the respective colors are arrayed around a single photosensitive drum 114, along its surround. Otherwise, the developing devices 117 of yellow, magenta, cyan, and black are arranged in a rotatable case. That is, the desired developing device 117 is made to face the photosensitive drum 114 to develop the desired color.

A patch sensor 126 is provided on the surface of the photosensitive drum 114 at a position between the developing device 117 and the opposite portion of the transfer belt 120 in the direction of rotation of the photosensitive drum 114. The patch sensor 126 detects the density of a developed image (patch) for density detection developed on the photosensitive drum 114 so as to control the toner supply amount to the developing device 117 and correct the LUT (lookup table) held by the γ converter 105. Details of toner supply control and tone correction by the LUT will be described later.

A controller 900 controls the units of the digital multi function peripheral. The controller 900 includes a CPU, a ROM that stores control programs, and a RAM that temporarily stores programs and data.

Figure 2:
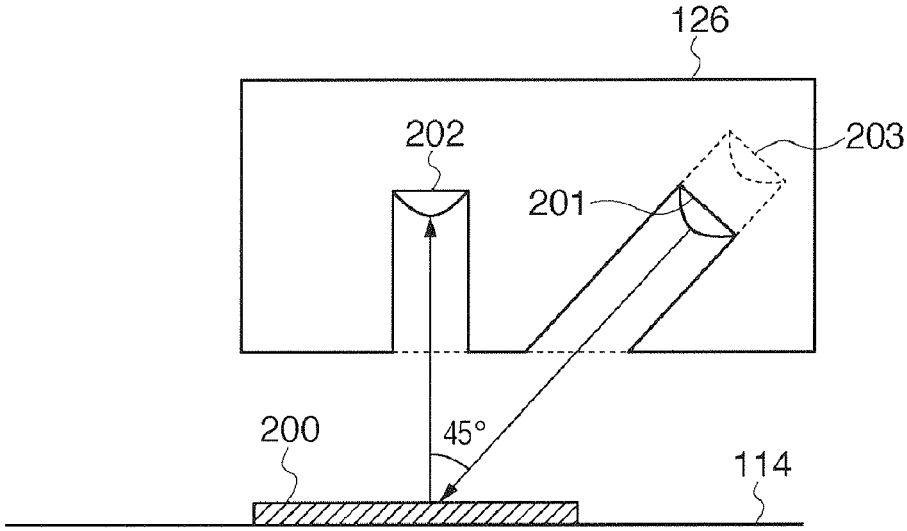
FIG. 2 is a view showing an example of a patch sensor 126.

FIG. 2 shows an example of the patch sensor 126. The patch sensor 126 includes a light source 201 such as an LED, a density measuring light-receiving element 202 that receives light emitted by the light source 201 and reflected by a patch image 200, and a light amount adjusting light-receiving element 203 that directly receives the light amount of the light source 201 to controls the light amount of the light source 201 to maintain a predetermined level.

Figure 3:
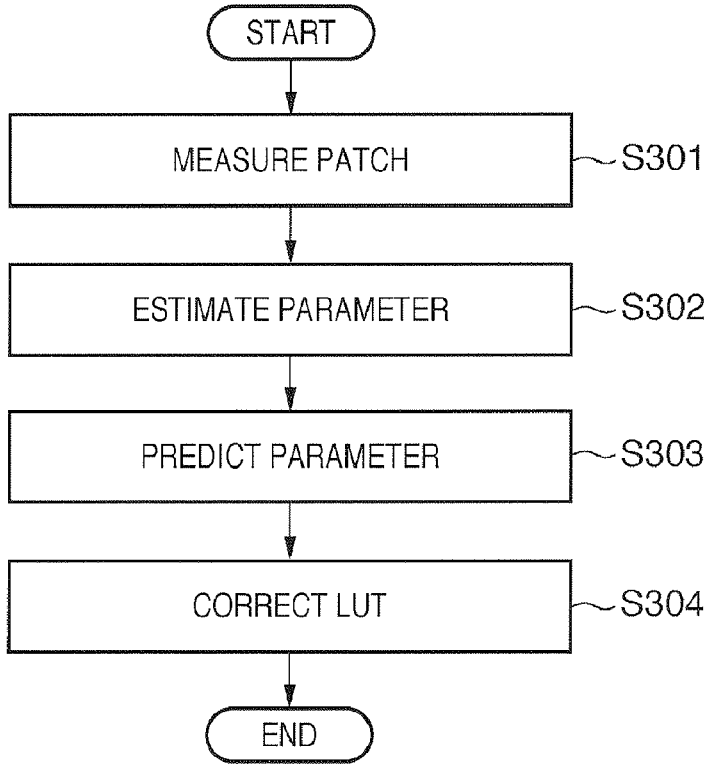
FIG. 3 is a flowchart illustrating processing to be performed by the digital multi function peripheral according to the first embodiment.

Toner supply processing and grayscale correction processing to be performed by the digital multi function peripheral will be described next with reference to the flowchart of FIG. 3. Note that the nucleus of the process of each step shown in FIG. 3 is the controller 900.

In step 5301, the controller 900 generates a patch image. The generated patch image is formed on the photosensitive drum 114 together with a print image (output image) based on image data acquired from outside as the actual print target. The controller 900 controls the patch sensor 126 so that it reads the density value of the patch image on the photosensitive drum 114 as a measured value.

Figure 4:
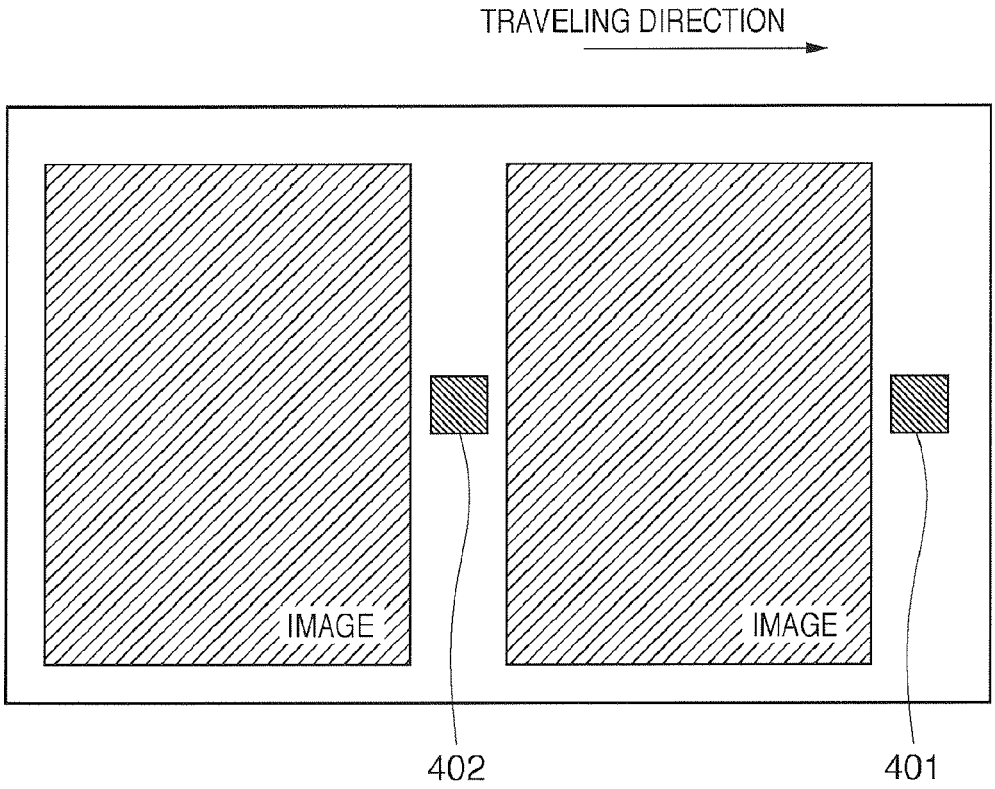
FIG. 4 is a view showing an example of a photosensitive drum 114 on which output images and patch images are formed.

FIG. 4 is a view showing an example of the surface of the photosensitive drum 114 on which print images and patch images are formed. As shown in FIG. 4, patch images 401 and 402 are formed at arbitrary timings and arbitrary density levels in regions where no print image is formed. Note that the patch image need not always be formed each time a print image is formed. For example, one patch image may be formed for every 10 A4 print images. The patch image forming frequency may be changeable based on the required accuracy. The density of the patch image may be a variable value or a predetermined fixed value regarded as important.

The patch sensor 126 reads the density of each patch image formed on the photosensitive drum 114. The print image formed on the photosensitive drum 114 is transferred to the transfer medium 121. After the patch sensor 126 has detected the density, the patch image is scraped off by the cleaner 125 without being transferred to the transfer medium 121.

In step S302, the controller 900 detects or estimates parameters. Examples of parameters are the toner density, toner charge amount, temperature and humidity in the image forming apparatus, and degree of carrier degradation. Toner density detection can be done using a sensor of optical reflectometry scheme or inductance detection scheme. To detect the toner charge amount, a calculation method using a potential sensor (PTL3) or the like is usable. Temperature and humidity can be detected by a general method. The degree of carrier degradation can be detected using, for example, an LUT of print count values, count values measured in advance, and degrees of degradation.

In this embodiment, the toner density and the toner charge amount will be described as parameters to be not measured by sensors but estimated. Other necessary parameters will be described as detectable parameters.

Image data of the image forming target is stored in the memory (not shown) of the digital multi function peripheral. Hence, the controller 900 first refers to the pixel values of the pixels of the image data and obtains the accumulated value (integrated value) of the pixel values. Based on the obtained accumulated value, the controller 900 estimates the toner consumption necessary for forming the print image of the image data. The controller 900 also acquires data representing the amount of toner supplied from a toner supplier (hopper) (not shown) to the developing device 117.

The controller 900 performs calculation processing based on the following formulas using the toner consumption and the toner supply amount. The formulas below are a model called "observer". "Observer" is similar to the observer in control engineering.

$$dx/dt=Ax+Bu \quad (1)$$

$$y=Cx+Du \quad (2)$$

This model is a state space model in control engineering. Equation (1) is an equation of state, and equation (2) is an equation of output. In equations (1) and (2), u is a 1×2 matrix representing the estimated toner consumption and the toner supply amount acquired by the controller 900, x is a 1×2 matrix (state variable) representing the toner density and the toner charge amount, y is the output patch density (output) corresponding to a certain input patch density level, and A, B, C, and D are a system matrix, control matrix, observation matrix, and direct matrix, respectively, defining the model. These matrices are determined by, for example, the advection diffusion of toner particles in the digital multi function peripheral and the rise characteristic of the toner charge amount. Calculations based on equations (1) and (2) enable prediction of variations in x and y. Next, the controller 900 performs calculation processing based on $$dx/dt=Ax+Bu-L(y_{obsv}-y_{plant}) \quad (3)$$

where $y_{obsv}$ is the output patch density γ in equation (2), $y_{plant}$ is the density value measured by the patch sensor 126, and L is the observer gain. The observer gain is a matrix used to correct the shift of the state amount in the model based on the difference between $y_{obsv}-y_{plant}$. Hence, the observer allows to more reliably estimate the matrix x, that is, the toner density and the toner charge amount.

In step S303, the controller 900 performs processing for obtaining the matrix x for image formation of the next time. This is because the parameters in the digital multi function peripheral vary and affect the density of the image to be formed as time elapses. As an example, the matrix x at a representative timing during the image formation processing of the next time is obtained.

First, the controller 900 obtains a time t from the current time to the image formation of the next time. Since the memory stores image data of the next image forming target, the controller 900 then refers to the pixel values of the pixels of the image data and obtains the accumulated value (integrated value) of the pixel values. Based on the obtained accumulated value, the controller 900 estimates the toner consumption necessary for printing the image based on the image data. The controller 900 also determines the toner supply amount. This allows determination of the matrix u representing the determined toner supply amount and the obtained toner consumption. The determined toner supply amount is assumed to equal the toner consumption for descriptive convenience, although it may be an arbitrary amount. That is, controlling the toner density to a predetermined value allows the above-described model to predict, for example, the change in the toner charge amount shown in FIGS. 11A to 11C.

The calculation processing of obtaining the matrix x for the image formation of the next time is executed again using the obtained matrix u and equation (1). Note that this calculation processing is done using the calculation result (matrix x) of the calculation of the preceding time as the initial value. Furthermore, the output patch density γ for the image formation of the next time is calculated from the obtained matrix x using equation (2).

In step S304, the controller 900 corrects the LUT held by the γ converter 105 based on the output patch density y calculated for the image formation of the next time. The corrected LUT is used in γ conversion of the image data of the next image forming target.

As described above, according to this embodiment, it is possible to predict a variation in the toner density and control the tone correction condition. This allows to always compensate for the grayscale characteristic. Note that in this embodiment, the grayscale characteristic is predictively controlled. However, this control may be used in combination with general feedback control.

In this embodiment, the patch image density is measured at an arbitrary timing. However, the measurement frequency may be changed in accordance with the shift amount between the predicted value and the actually measured value. The measured value is not limited to the density and may be another value such as the reflectance, tone weight, or toner charge amount which enables estimation of the quantity of state of the patch image.

In this embodiment, the parameter prediction timing is a representative timing during the image formation processing of the next time. However, the present invention is not limited to this. For example, a plurality of parameter prediction timings may be set. Prediction results at the respective timings may be averaged, and the average value may be obtained as the predicted value.

In this embodiment, toner supply is arbitrarily done. Instead, the toner supply amount may be determined such that the difference between parameters obtained at the respective timings is minimized, thereby minimizing the variation in the density during image output.

In this embodiment, the toner density and the toner charge amount are estimated. These values may be detectable using a sensor or the like. If approximation using a state space model is possible, and the observer can be designed at this time, other parameters may further be estimated.

[Second Embodiment]

Figure 5:
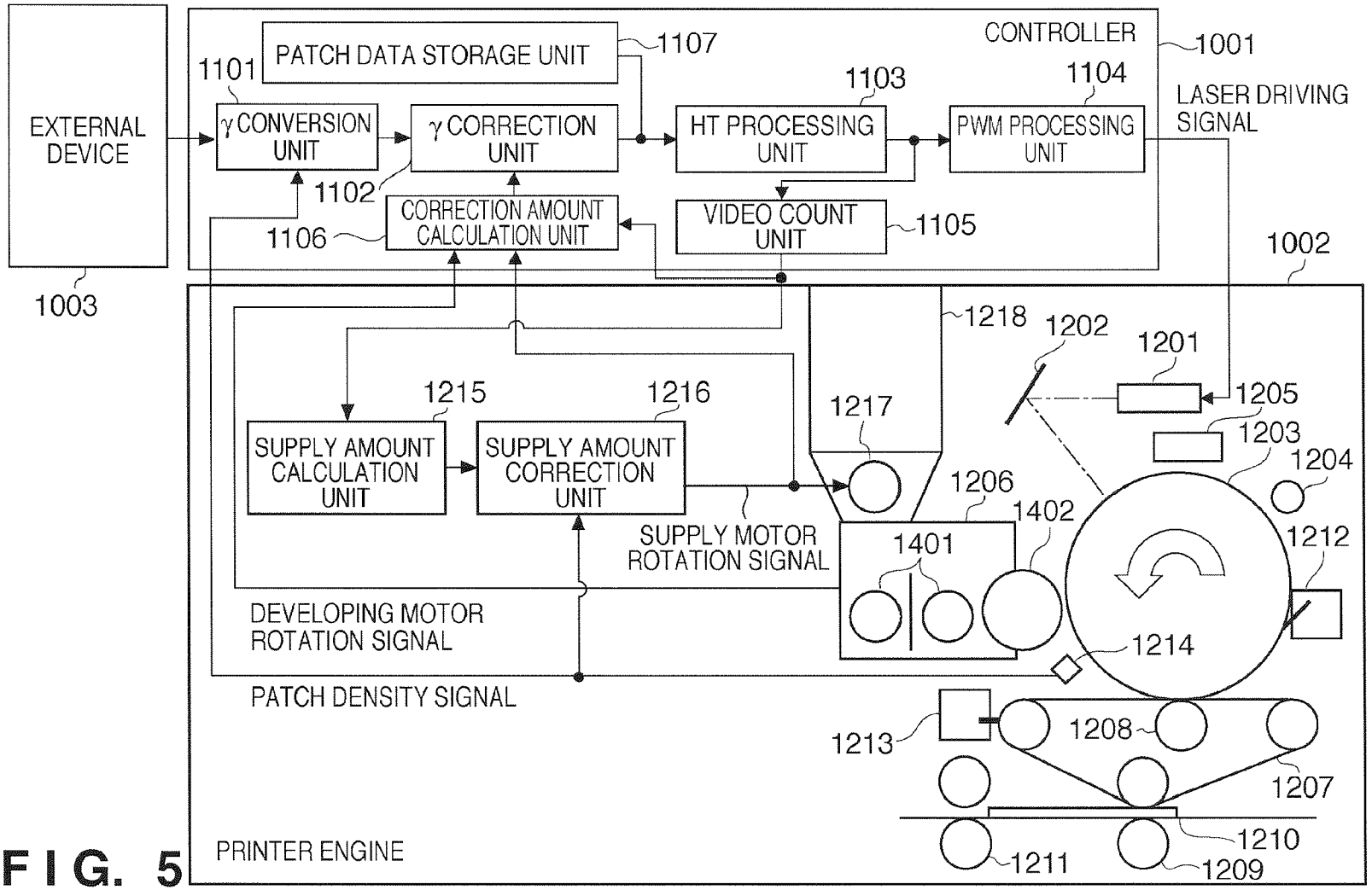
FIG. 5 is a block diagram showing the arrangement of an image forming apparatus according to the second embodiment.

An image forming apparatus according to this embodiment includes an image processing unit which performs image processing of an image signal using an image processing condition, and an image forming unit which forms an output image by electrophotography based on the processed image signal using a controlled process condition. More specifically, the image forming apparatus forms an electrostatic latent image on an image carrier such as a photosensitive member or dielectric by electrophotography, electrostatic recording, or the like, corrects the tone characteristic of the electrostatic latent image as needed, and causes a developing device entailing developer supply to develop the electrostatic latent image, thereby forming a visible image. FIG. 5 is a block diagram showing an example of the arrangement of the image forming apparatus according to this embodiment.

A controller 1001 receives an image signal from an external device 1003 and issues a print instruction. The external device 1003 has interfaces to a hard disk drive, computer, server, network, and the like (not shown) so as to output an image signal.

A γ conversion unit 1101 performs γ conversion (first tone correction) of the image signal from the external device 1003 using a lookup table (LUT). Next, a γ correction unit 1102 performs γ correction (second tone correction) of the image signal from the γ conversion unit 1101 using an LUT. An HT processing unit 1103 performs halftone processing (HT processing) of the image signal that has undergone the tone correction of the γ correction unit 1102.

A PWM processing unit 1104 compares the image signal that has undergone the halftone processing with a triangle wave signal having a predetermined period, and outputs a pulse-width-modulated laser driving signal. The laser driving signal is output to a printer engine 1002. A laser diode 1201 receives the laser driving signal and emits a laser beam. The emitted laser beam irradiates the surface of a photosensitive drum 1203 that is an image carrier rotating in the direction of an arrow via a polygon mirror (not shown), an fθ lens (not shown), and a reflecting mirror 1202. This forms an electrostatic latent image on the photosensitive drum 1203.

The photosensitive drum 1203 is uniformly discharged by an exposure device 1204 and then uniformly charged by a charger 1205. After that, an electrostatic latent image corresponding to the print image is formed on the photosensitive drum 1203 irradiated with the above-described laser beam. The electrostatic latent image is developed to a visible image (toner image) by toner supplied from a developing device (developing unit) 1206.

At this time, a DC bias component corresponding to the electrostatic latent image forming condition and an AC bias component for improving the developing efficiency are superimposed and applied to the developing device 1206. The developing device 1206 includes a plurality of agitating screws 1401 and a developing sleeve 1402. A developer (carrier) and toner (neither are shown) are stored in the developing device 1206. The agitating screws 1401 are driven to agitate the carrier and toner so as to frictionally electrify the toner. The developing sleeve 1402 rotates with the charged toner and carrier adhered to its surface, thereby supplying the toner to the electrostatic latent image on the photosensitive drum 1203.

The developed toner image is transferred by the function of a primary transfer device 1208 onto a belt-like transfer medium carrier (transfer belt) 1207 that loops over a plurality of rollers and is endlessly driven. The toner image transferred to the transfer medium carrier 1207 is transferred onto a transfer medium 1210 by a secondary transfer device 1209. The transfer medium 1210 is conveyed through a fixing device 1211 so as to fix the toner image onto the transfer medium 1210. Then, the transfer medium 1210 is discharged.

The residual toner remaining on the photosensitive drum 1203 is scraped off by a cleaner 1212 and collected. The residual toner still remaining on the transfer medium carrier 1207 after separating the transfer medium 1210 is scraped off by a cleaner 1213 such as a blade.

Figure 12:
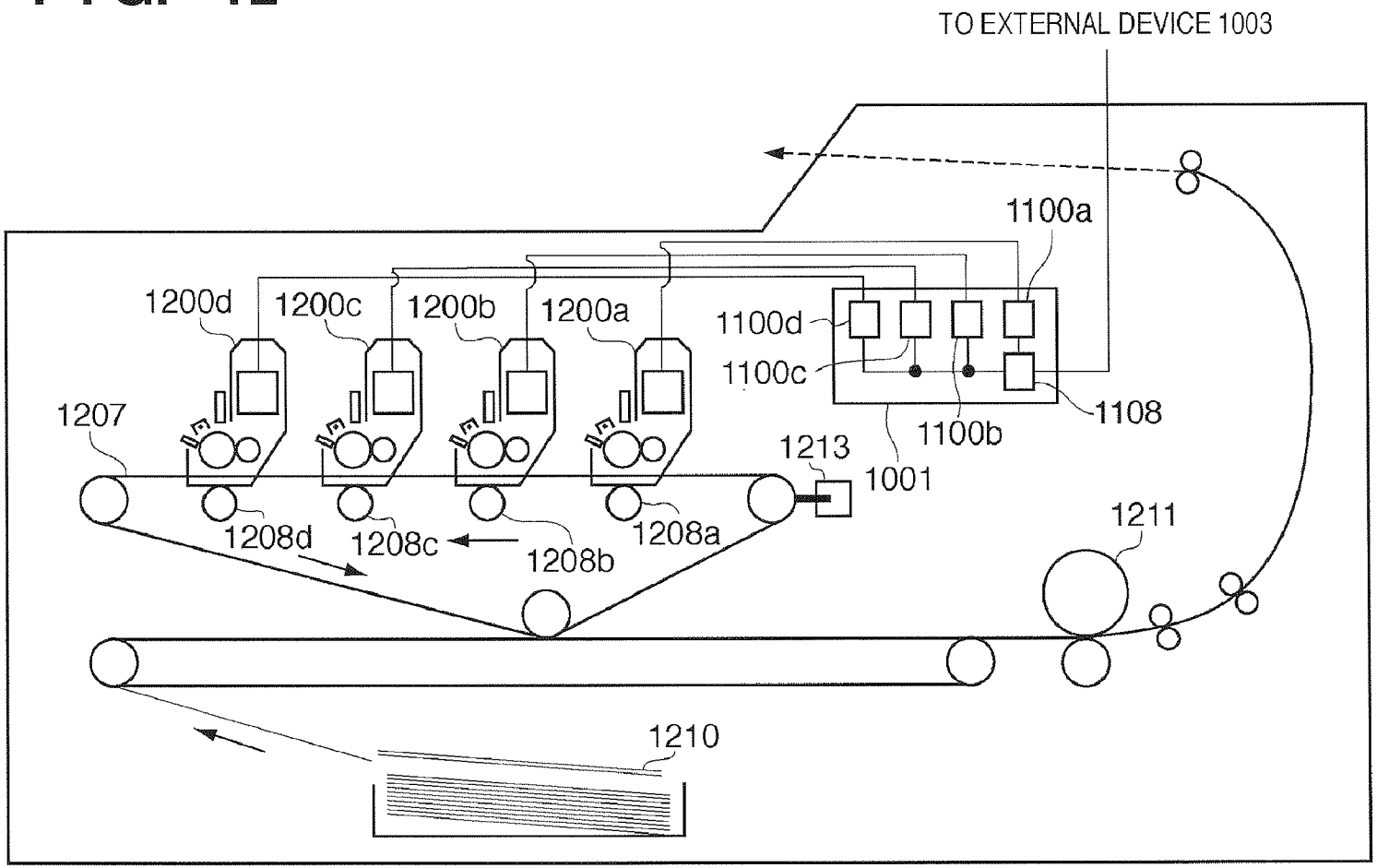
FIG. 12 is a schematic view showing an example of the arrangement of an image forming apparatus including sequentially arrayed image forming stations.

Note that FIG. 5 illustrates only a single image forming station (including the photosensitive drum 1203, charger 1205, developing device 1206, and the like) for descriptive convenience. For color image formation, however, image forming stations corresponding to, for example, cyan, magenta, yellow, and black are sequentially arrayed on the transfer medium carrier 1207 along its moving direction. Alternatively, the developing devices 1206 of the respective colors are arrayed around a single photosensitive drum 1203, along its surround. Otherwise, the developing devices 1206 of yellow, magenta, cyan, and black are arranged in a rotatable case. That is, the desired developing device 1206 is made to face the photosensitive drum 1203 to develop the desired color. FIG. 12 is a view showing an example of the arrangement of an image forming apparatus including four sequentially arrayed image forming stations. The controller 1001 includes the following units.

a color separation unit 1108 which separates the image signal into respective colors signal processing units 1100*a*, 1100*b*, 1100*c*, and 1100*d* (each including the γ conversion unit 1101, γ correction unit 1102, HT processing unit 1103, PWM processing unit 1104, video count unit 1105, correction amount calculation unit 1106, and patch data storage unit 1107) of the respective colors Each of image forming stations 1200*a*, 1200*b*, 1200*c*, and 1200*d* is controlled by a corresponding signal processing unit. Note that each image forming station includes the laser diode 1201, reflecting mirror 1202, photosensitive drum 1203, exposure device 1204, charger 1205, developing device 1206, cleaner 1212, supplier 1217, and toner tank 1218.

A patch sensor 1214 (having the same arrangement as in the first embodiment) is provided at a position between the developing device 1206 and the opposite portion of the transfer medium carrier 1207. The patch sensor 1214 detects the density of a developed image (patch) for density detection developed on the photosensitive drum 1203 so as to control toner supply to the developing device 1206 and correct the LUT (lookup table) held by the γ conversion unit 1101. Details of toner supply control and tone correction by LUT correction will be described later.

Toner supply processing to be performed by the image forming apparatus will be described next. The video count unit 1105 integrates image signals per page output from the HT processing unit 1103, and outputs the integrated value to a supply amount calculation unit 1215 as a video count value VC. The video count value VC is the integrated value of signal values $n_{i,j}$ (i and j are vertical and horizontal coordinates) of the pixels included in the image of one page, and is given by $$VC=n_{1,1}+n_{1,2}+n_{1,3}+\ldots n_{2,1}+n_{2,2}+n_{2,3}+\ldots n_{w,h} \quad (4)$$

where w is the width of the image, and h is the height of the image. Based on the video count value VC, the supply amount calculation unit 1215 predicts a toner amount T to be consumed by the image forming apparatus to print one page by $$T=VC\times k \quad (5)$$

where k is the coefficient representing the toner weight per unit signal value. Actually, the toner amount to be consumed varies depending on the temperature, humidity, the state of the developing device 1206, and the like. Hence, the predicted toner amount contains an error, unlike the toner amount to be actually consumed.

Based on the patch density detected by the patch sensor 1214, the supply amount correction unit 1216 adjusts the toner supply amount and outputs a supply motor rotation signal corresponding to the adjusted toner supply amount. The supply motor rotation signal is that for rotatably driving a supply motor provided in the supplier 1217. A supply motor rotational speed N represented by the signal is given by $$N=(T+k_d\times(D_{target}-D)+T_{rem})\div T_{div}$$

$$T_{rem}(n+1)=(T+k_d\times(D_{target}-D)+T_{rem})-N\times T_{div} \quad (6)$$

where "÷" is the symbol of remainder operation, $T_{div}$ is the toner supply amount per revolution of the supply motor provided in the supplier 1217, D is the patch density value measured by the patch sensor 1214, $D_{target}$ is the target patch density value, $k_d$ is the coefficient to determine the supply adjustment amount, and $T_{rem}$ is the remainder at the preceding time of calculating a "toner supply amount Th per print page to be supplied from the toner tank 1218 to the developing device 1206".

The supplier 1217 preferably supplies toner in the same amount as the toner amount to be consumed so as to always control the toner amount in the developing device 1206 to a predetermined amount. However, the toner amount calculated by the supply amount calculation unit 1215 and the toner amount to be supplied from the supplier 1217 contain an error. To compensate for the error, the supply amount is adjusted using the patch density. This adjustment uses the correlation between the toner amount remaining in the developing device 1206 and the density of the developed patch image. If the patch density measured by the patch sensor 1214 is lower than an assumed density, the toner amount in the developing device 1206 has probably decreased, and therefore, the supply amount is increased. Conversely, if the patch density is higher, the supply amount is decreased. The toner amount in the developing device 1206 is maintained constant by the above-described adjustment. Since the supplier 1217 is driven only in a unit of revolution, the amount of toner that could not be supplied is carried over to the subsequent calculation.

Next, the supplier 1217 rotates the supply motor in accordance with the supply motor rotation signal output from the supply amount correction unit 1216 by the supply motor rotational speed N represented by the signal, thereby supplying the toner stored in the toner tank 1218 to the developing device 1206. This allows for supply of the toner based on the designated toner supply amount.

Note that the supplier 1217 is driven in a unit of revolution because the blades (so-called tooth portions) of the screws return to the same positions by one revolution, and the supply amount stabilizes, except in cases where supply control is done in consideration of the supply amount difference generated by the rotation phase or another supply method is used.

Tone conversion processing to be performed by the image forming apparatus will be described next. The tone conversion processing is performed in two steps by the γ conversion unit 1101 and the γ correction unit 1102. A method of creating the LUT to be used by the γ conversion unit 1101 will be described first with reference to the flowchart of FIG. 7A.

The image forming apparatus has a unique tone characteristic. When the image signal from the external device 1003 is directly output via the HT processing unit 1103 and the PWM processing unit 1104, the image signal and its output density hold a relationship represented by, for example, a characteristic 500 before γ conversion shown in FIG. 6A. As the tone characteristic of the image forming apparatus, the density or brightness of the output image is normally preferably linear to that of the input signal. To obtain the desired tone characteristic, the controller 1001 creates a γ-LUT.

First, the controller 1001 determines based on a preset condition whether to create the γ-LUT (step S601). If there is a possibility that the tone characteristic has considerably changed, for example, immediately after activation of the image forming apparatus or after a predetermined number of sheets, for example, 5000, have been printed, the controller 1001 determines to create the γ-LUT. Upon determination to create the γ-LUT, the process advances to step S602. On the other hand, upon determination not to create the γ-LUT, the processing ends. In this embodiment, when the controller 1001 decides to create the γ-LUT, image output based on the print instruction is stopped, patches of a plurality of tones are formed, and γ-LUT creation processing is executed.

In step S602, the patch data storage unit 1107 outputs the patch data of the plurality of tones to the HT processing unit 1103. The patch data includes 17 tone patches (0, 16, 32, . . . , 255 in 8 bits) in which the input signal values are arranged at a uniform interval to calculate the tone characteristic. Each patch has a size of, for example, 1-cm square to allow the patch sensor 1214 to detect the density. The number of tones of patches and the number of patches are not particularly limited, as a matter of course.

With the above-described operation of forming a latent image on the photosensitive drum 1203, the latent images of the patches of the plurality of tones are formed on the photosensitive drum 1203 using the patch data that has undergone the halftone processing of the HT processing unit 1103 (step S603). Next, the patch sensor 1214 measures the density of each patch on the photosensitive drum 1203 (step S604).

Figure 6A:
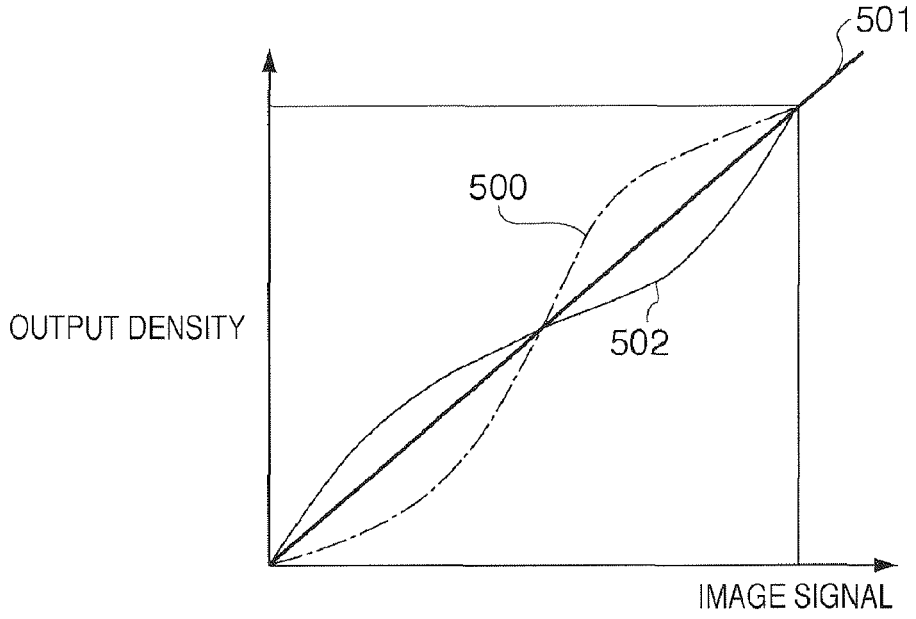
FIG. 6A is a view for explaining a tone characteristic and a correction LUT.

The γ conversion unit 1101 receives, from the patch sensor 1214, a patch density signal representing the density of each patch measured in step 5604, creates a γ-LUT from the tone characteristic of the image forming apparatus based on the patch density signal, and stores the γ-LUT (step S605). A characteristic (solid line) reverse to a characteristic (dotted line) before the γ conversion calculated based on the density of each patch obtained in step S604 is calculated from the characteristic before the γ conversion. The γ-LUT is created based on the reverse characteristic. FIG. 6A is a view showing the relationship among the characteristic 500 before conversion, a γ-LUT 502 having a reverse characteristic, and an ideal characteristic 501.

The γ-LUT creation of the γ conversion unit 1101 takes time for outputting the plurality of patches and measuring the density. For this reason, the productivity considerably lowers if the γ-LUT creation processing of the γ conversion unit 1101 is performed at a high frequency for, for example, each print. In addition, since the γ-LUT creation entails toner consumption and supply, strictly, the tone characteristic of the image forming apparatus changes.

In this embodiment, the γ correction unit 1102 predicts the tone characteristic based on the input data, thereby correcting the tone characteristic at a high frequency without requiring the time for the patch output and the like. That is, the γ conversion unit 1101 corrects the basic tone characteristic that has varied in a long time due to, for example, the aging degradation of the image forming apparatus, and the γ correction unit 1102 corrects the tone characteristic that has varied in a short time.

As described above, the γ correction unit 1102 is used to compensate for a variation that has occurred in a short time, that is, a variation in the developing toner amount caused by, for example, toner agitation, toner supply, and toner consumption upon development. Such a variation resulting from the toner state occurs in a short time where, for example, several sheets are printed and output, as described with reference to FIGS. 11A to 11C. Thus, the correction amount calculation unit 1106 calculates the correction amount for each print to correct the tone characteristic.

For example, based on the predicted value of the toner charge amount at the start of printing of the (n−1)th sheet, the γ correction unit 1102 predicts the toner charge amount at the end of printing of the (n−1)th sheet (at the start of printing of the nth sheet) using the process variation information of the engine for the printing of the (n−1)th sheet. The process variation information represents the variation information of the toner consumption, supply motor rotational speed, and developing motor rotational speed. The tone conversion condition (γ-LUT) is created by calculating the output density based on the predicted toner charge amount.

The tone conversion processing of the γ correction unit 1102 will be explained with reference to the flowchart of FIG. 7B. The controller 1001 determines based on a preset condition whether to predict the toner charge amount (step S701). The condition of prediction will be described later. When deciding not to predict the toner charge amount as a result of the determination, the processing ends. When deciding to predict the toner charge amount, the process advances to step 5702.

Upon receiving the video count value VC from the video count unit 1105, the correction amount calculation unit 1106 predicts the toner consumption T per print to be consumed by the developing device 1206 (step S702). The toner consumption T is obtained by equation (5), as in the supply amount calculation unit 1215.

Note that in this embodiment, the correction amount calculation unit 1106 calculates the toner consumption T by acquiring the video count value VC from the video count unit 1105. However, the toner consumption T may be acquired from the supply amount calculation unit 1215.

Using the supply motor rotation signal (supply motor rotational speed N) from the supply amount correction unit 1216, the correction amount calculation unit 1106 predicts a toner supply amount Th per print from the toner tank 1218 to the developing device 1206 by $$Th=N\times T_{div} \tag{7}$$

(step S703).

Next, the correction amount calculation unit 1106 receives the rotation time of the agitating screws 1401 from the developing device 1206 as an agitation time $t_{on(n-1)}$ (step S704). Details of the information acquired by the correction amount calculation unit 1106 in steps S702, S703, and S704 will be described with reference to FIG. 8 showing an order of each processing.

Figure 8:
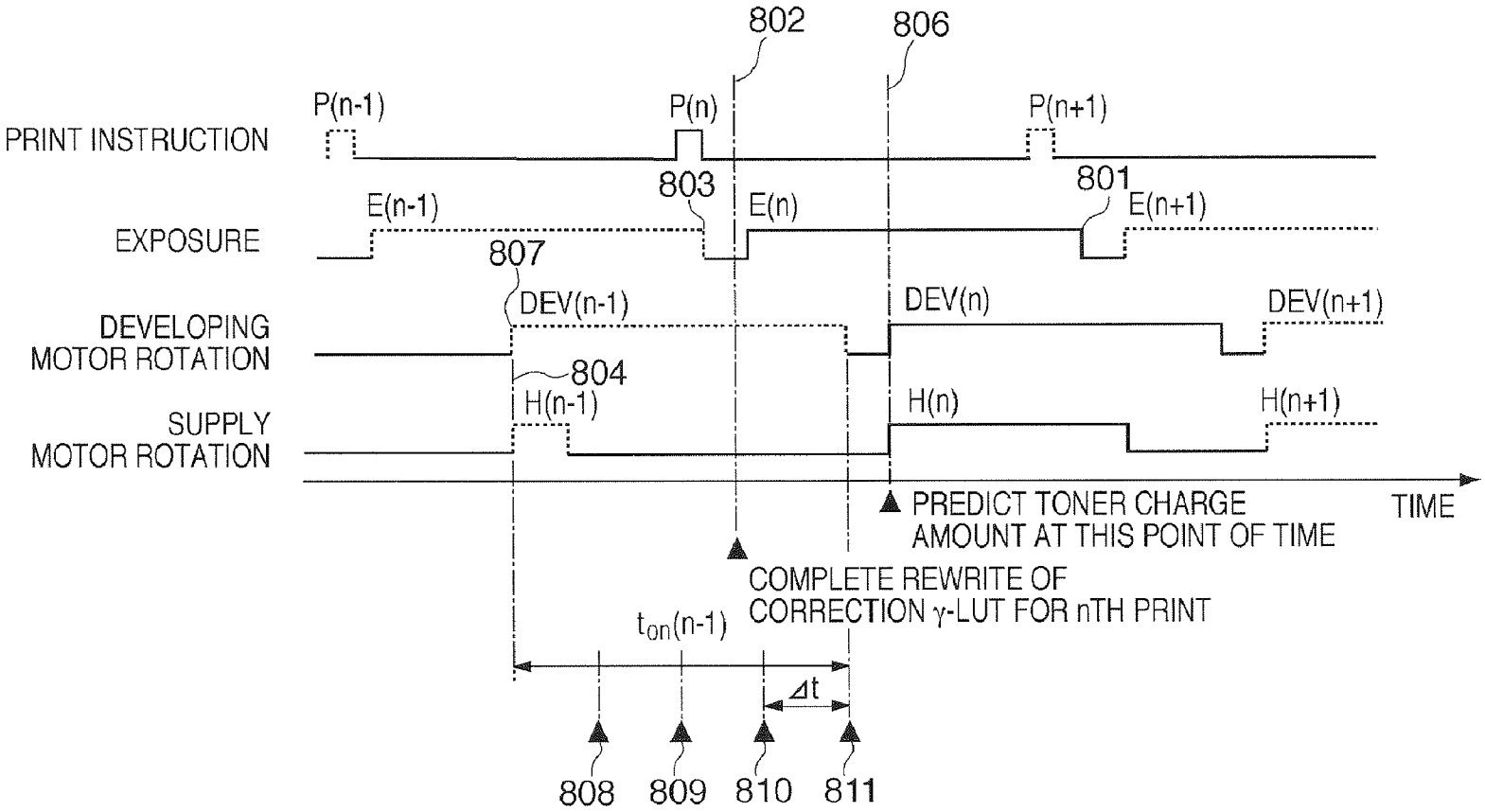
FIG. 8 is a view for explaining the operation timing of the image forming apparatus.

The uppermost chart of FIG. 8 represents the print instruction issue timing. The image forming apparatus operates at a leading edge P(n) (nth print instruction) of the issue timing signal. First, when a control unit (not shown) issues P(n), the controller 1001 starts processing the image signal. At timing E(n), the laser diode 1201 performs exposure processing based on the laser driving signal output from the controller 1001. The video count unit 1105 starts calculating the video count value and determines the video count value of the nth print at a timing 801 of the end of the exposure processing. The control unit (not shown) outputs a developing motor rotation signal DEV(n) at the timing the latent image formed on the photosensitive drum 1203 by the exposure processing faces the developing device 1206. Upon receiving the developing motor rotation signal DEV(n), the developing device 1206 drives the agitating screws 1401 and the developing sleeve 1402. The rotation time (agitation time $t_{on}$) of the agitating screws 1401 is decided by the agitation time deciding function executed by the control unit (not shown) based on the rotational speed of the photosensitive drum 1203 and the size of the nth image acquired upon issuing P(n).

In addition, the supply motor operates at a timing H(n) corresponding to the leading edge of the developing motor rotation signal DEV(n) so as to supply the toner to the developing device 1206. At a timing 802 before rising of the exposure processing of the nth sheet, the γ correction unit 1102 receives P(n) and starts processing. The γ-LUT to be used for tone conversion of the γ correction unit 1102 needs to have already been rewritten at this timing. The pieces of information acquired in steps S702, S703, and S704 are acquired before this.

The video count value VC acquired in step S702 is the video count value for the (n−1)th sheet (that is, the toner consumption upon printing the (n−1)th sheet) which is determined at a trailing edge timing 803 of the exposure timing E(n−1) of the (n−1)th sheet.

The toner supply amount Th acquired in step S703 is the amount of toner to be supplied at a supply motor rotation timing H(n−1), which is calculated using a supply motor rotational speed N(n−1) determined at a leading edge timing 804 of H(n−1).

The agitation time $t_{on}$ acquired in step S704 is the driving time of the developing motor rotation signal DEV(n−1). The time, which is determined immediately after issuing the print instruction P(n−1), is used.

Next, the correction amount calculation unit 1106 predicts the toner charge amount at the end of printing of the (n−1)th sheet (at the start of printing of the nth sheet) using the above-described information for printing of the (n−1)th sheet (step S705). The correction amount calculation unit 1106 calculates an average toner charge amount y in the developing device 1206 using equations (8) and (9) to be described below. In this embodiment, toner charge amount prediction is done using the state space model in control engineering. The state space model is a mathematical model represented by first-order simultaneous differential equations using an input, output, and state variables. That is, in this embodiment, the variation characteristic of the toner charge amount in the developing device 1206 is approximated by the simultaneous differential equations, and the toner charge amount y at the start of printing of the nth sheet is estimated using the state space model represented by $$dx/dt=Ax+Bu \tag{8}$$

$$y=Cx+Du \tag{9}$$

where u is a 1×2 matrix including the toner supply amount $\{Th/t_{on(n-1)}\}$ per unit time and the toner consumption $\{T/t_{on(n-1)}\}$ per unit time. The matrix u can be calculated based on the toner consumption T(n−1), toner supply amount Th(n−1), and agitation time $t_{on(n-1)}$ calculated in steps S702, S703, and S704.

Figure 11A:
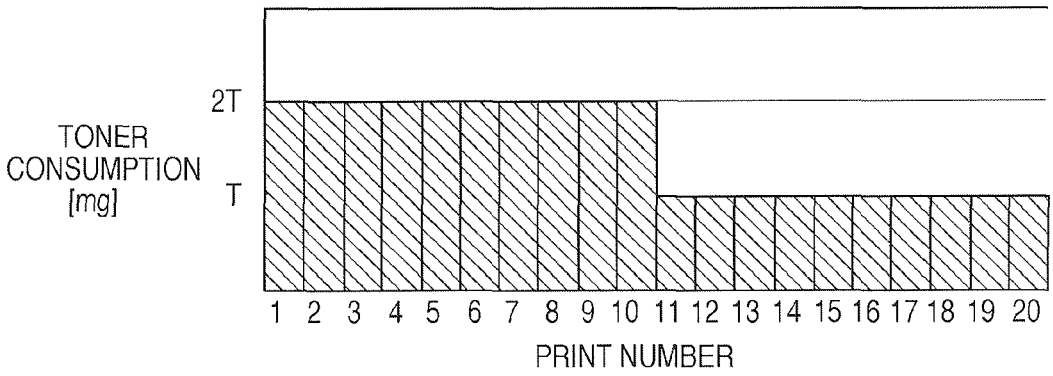
FIG. 11A is a graph showing the toner consumption of each printed sheet.
Figure 11B:
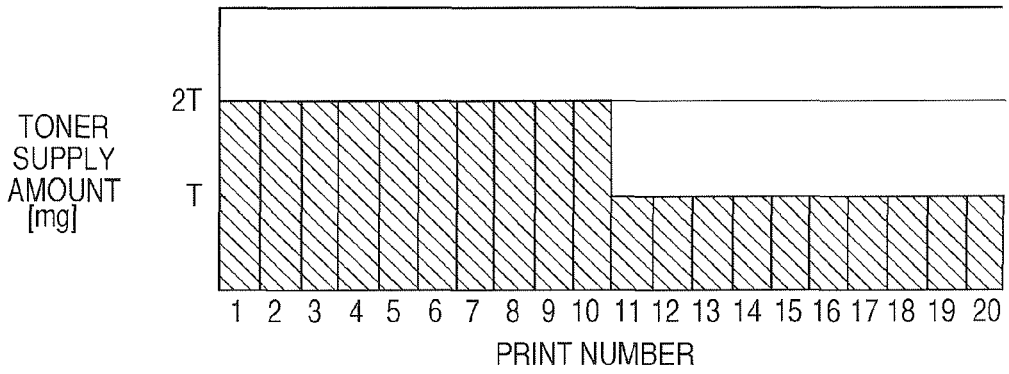
FIG. 11B is a graph showing the toner supply amount of each sheet.
Figure 11C:
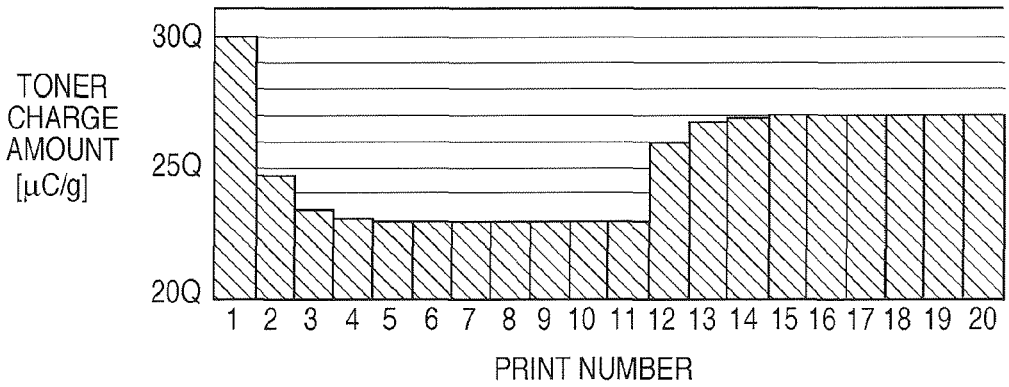
FIG. 11C is a graph showing the toner charge amount at the start of printing each sheet under the circumstances illustrated in FIGS. 11A and 11B.

The x is a 1×2 matrix (state variable) representing the toner density and the toner charge amount, and A, B, C, and D are a system matrix, control matrix, observation matrix, and direct matrix, respectively, defining the model. That is, equations (8) and (9) approximate the variation characteristic of the toner charge amount in the developing device 1206 by the simultaneous differential equations. The matrices A, B, C, and D can use unique values by experiments in advance. For example, when toner consumption and toner supply are performed as shown in FIGS. 11A to 11C, the variation in the toner charge amount can be measured in advance by measuring the surface potential of the photosensitive drum 1203 and the weight of the developed toner image. Using system identification in control engineering enables obtaining of the matrices A, B, C, and D from the measured data.

The above calculation will be described in more detail. In FIG. 8, $t_{on(n-1)}$ is the time during which the toner charge amount changes due to consumption, supply, and agitation of the toner for printing of the (n−1)th sheet. The correction amount calculation unit 1106 obtains the change in the toner charge amount in the time $t_{on(n-1)}$ by repeating equations (8) and (9) $t_{on(n-1)}/\Delta t$ times, where Δt is the unit time of calculation.

When a developing motor rotation start time 807 is t=0, a toner charge amount y(n−1) at that point in time has been predicted by the preceding calculation. Along with the calculation, a state variable x0 is also held. The correction amount calculation unit 1106 then calculates a state variable x1 at a time 808 (t1=Δt) by equation (8). This can be rewritten as $$x1=x0+Ax0+Bu \tag{10}$$

Similarly, calculation to obtain a state variable x2 at a time 809 (t2=t1+Δt) is represented by $$x2=x1+Ax1+Bu \tag{11}$$

The calculation is similarly repeated. In a state in which a state variable x4 at a time 811 is calculated, equation (9) is calculated. This can be written as $$y4=Cx4+Du \tag{12}$$

Assuming that the toner charge amount does not change during the time from the time 811 to a time 806, the toner charge amount at the time 806 (that is at the start of printing of the nth sheet) can be predicted by $$y(n)=y4 \tag{13}$$

Figure 9A:
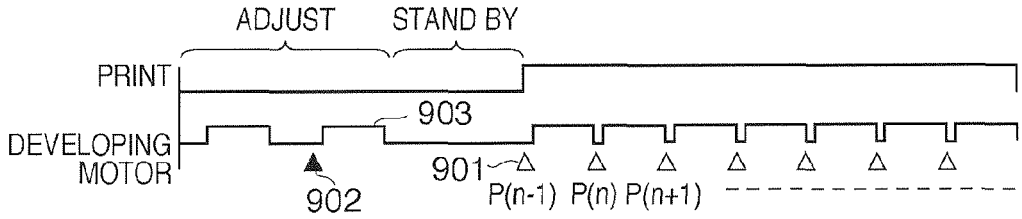
FIG. 9A is a view for explaining the operation timing of the image forming apparatus.

Note that the state variable x4 is stored for the next calculation. Toner charge amount prediction processing to be performed by the correction amount calculation unit 1106 will be explained next. FIG. 9A is a view showing the relationship between print processing and developing motor driving to be performed by the image forming apparatus. The developing motor operates during print processing. However, the developing motor also operates at the time of adjusting the image forming apparatus, for example, upon confirming the operation immediately after activation or creating the LUT to be used by the γ conversion unit 1101. For this reason, the toner charge amount changes. Hence, the condition of toner charge amount prediction is the timing before the developing motor driving (a timing 901 before print processing and a timing 902 before the developing motor rotates for another processing) in FIG. 9A. When this condition is satisfied, the processing in steps S702 to S705 is performed to update the values of the state variable x and toner charge amount y.

Next, the controller 1001 determines whether to create the γ-LUT (S706). In this case, since the correction is performed for every sheet to be printed, the processing is done at the timing 901 before print processing. That is, at the timing 901 before print processing shown in FIG. 9A, the values of the state variable x and the toner charge amount y are updated in steps S702 to S705, and the γ correction unit 1102 creates the γ-LUT in steps S707 to S709. On the other hand, at the timing 902 the developing motor rotates without print processing, only the processing in steps S702 to S705 is executed to update the values of the state variable x and the toner charge amount y.

At this time, the toner charge amount y at the time of creating the patches to rewrite the γ-LUT of the γ conversion unit 1101 is particularly stored as a reference toner charge amount $y_{norm}$. For example, if the processing in steps S601 to S605 is performed during a developing motor rotation period 903 without printing shown in FIG. 9A, the γ-LUT of the γ conversion unit 1101 is rewritten based on the prediction toner charge amount $y_{norm}$ at the timing 902. This allows for obtaining an ideal tone characteristic. This state is defined as the reference state in the subsequent processing. The tone characteristic is corrected by the processing in steps S707 to S709 based on the variation in the toner charge amount from the reference state.

Figure 9B:
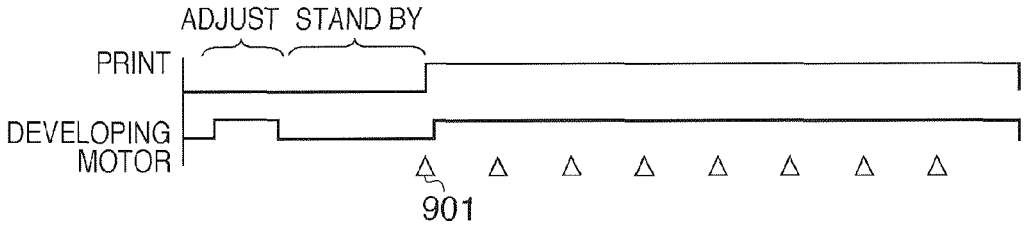
FIG. 9B is a view for explaining the operation timing of the image forming apparatus.
Figure 9C:
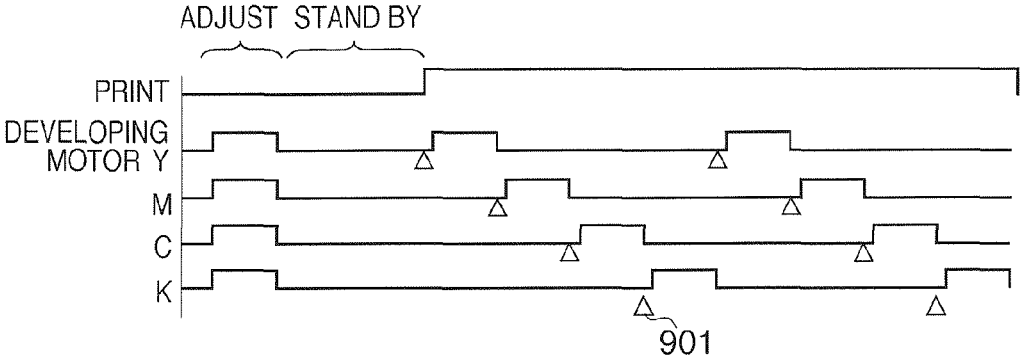
FIG. 9C is a view for explaining the operation timing of the image forming apparatus.
Figure 10:
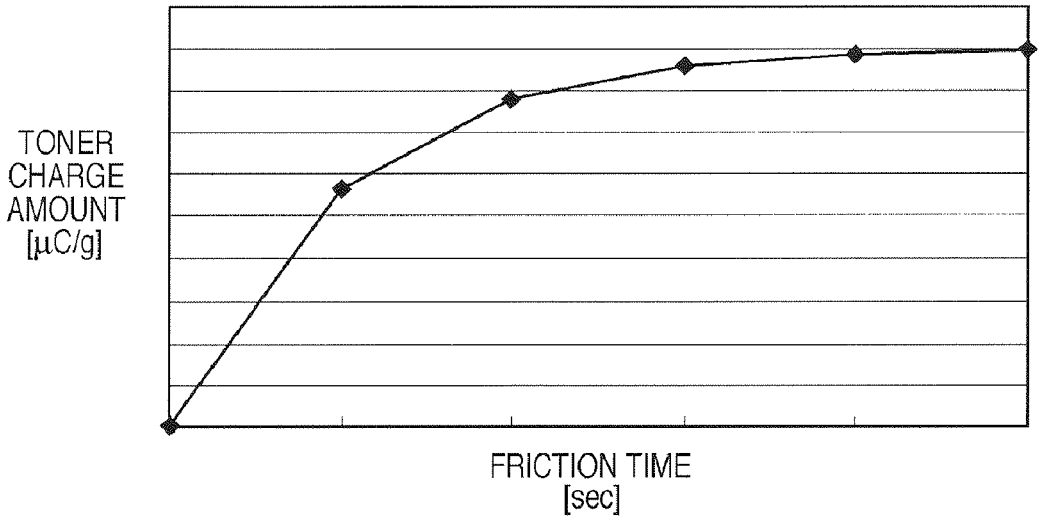
FIG. 10 is a view showing the relationship between the friction time and the toner charge amount.

Note that in the embodiment described here, developing motor activation and stop are done once per print. However, even in an image forming apparatus which continuously rotates the developing motor for a plurality of prints, as shown in FIG. 9B, the toner charge amount at the start of each printing can be predicted. In an image forming apparatus which rotates and sequentially uses a plurality color of image forming stations, the developing motors of the respective colors operate independently, as shown in FIG. 9C. In this case, the toner charge amount is predicted at the timing of each color.

The correction amount calculation unit 1106 then obtains a toner weight variation ΔM per unit area by, using the predicted toner charge amount y and the reference toner charge amount $y_{norm}$, performing $$\Delta M=M-M_{norm}=ky/y-ky/y_{norm} \tag{14}$$

(step S707).

A toner weight M represents the toner amount developed when developing a predetermined electrostatic latent image, and ky is the a constant of proportionality representing the relationship between the toner charge amount and the toner weight. This indicates a relationship that the toner weight M developed for a predetermined electrostatic latent image is inversely proportional to the toner charge amount y. In this embodiment, the latent image is used to form the maximum density portion based on the maximum input signal value 255. Note that the toner weight of another density portion may be obtained.

Next, the correction amount calculation unit 1106 converts the toner weight variation ΔM per unit area into an output density variation ΔOD (step S708). The relationship between the toner weight M per unit area and an output density OD is uniquely determined when using the same transfer medium 1210. For this reason, the conversion in step S708 can easily be performed using a transformation or an LUT created in advance.

Figure 6B:
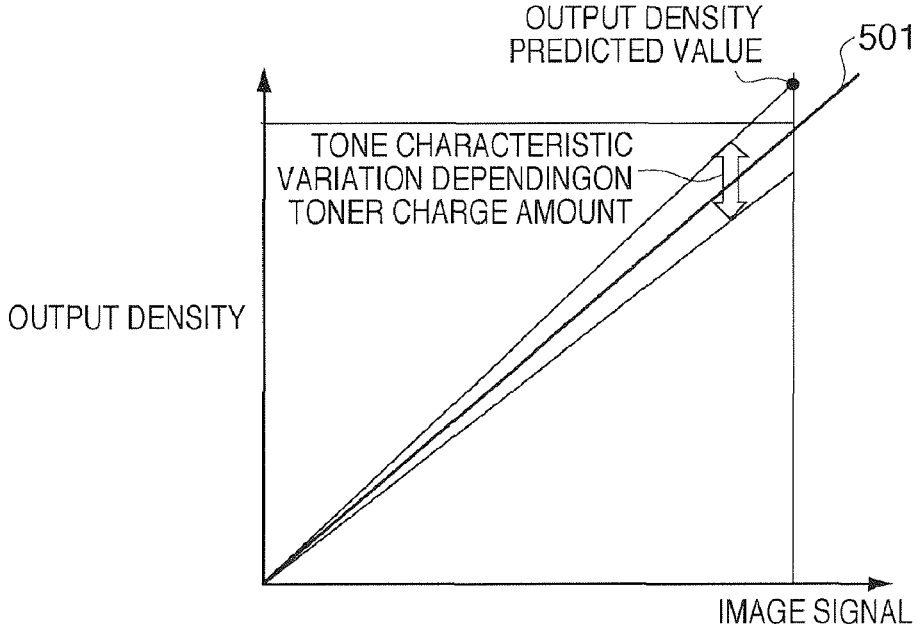
FIG. 6B is a view for explaining a tone characteristic and a correction LUT.

Next, the γ correction unit 1102 receives the output density variation ΔOD for the maximum value 255 of the input image signal from the correction amount calculation unit 1106, and creates the γ-LUT (step S709). FIG. 6B is a view showing the tone characteristic variation depending on the toner charge amount. The relationship between the density variation for the maximum value 255 of the input image signal and the density variation of another tone is uniquely determined based on the relationship among the latent image, the toner charge amount, and the toner weight. It is therefore possible to predict the overall tone characteristic by grasping the density (maximum density here) of a given tone. The γ correction unit 1102 creates a γ-LUT having a characteristic reverse to the obtained tone characteristic and stores it. The γ correction unit 1102 also performs γ conversion processing using the γ-LUT. This allows correction of the change in the grayscale characteristic caused by the variation in the toner charge amount.

As described above, according to this embodiment, it is possible to correct the grayscale by predicting the variation in the toner charge amount from the toner consumption, toner supply amount, and toner agitation time and thus predicting the grayscale characteristic. This enables to always obtain an output image having a stale grayscale characteristic. The γ conversion unit 1101 can correct the basic tone characteristic that has varied over a long time due to, for example, the aging degradation of the image forming apparatus, and the γ correction unit 1102 can correct the tone characteristic that has varied over a short time. This makes it possible to consistently maintain the tone characteristic at a desired characteristic level without degrading throughput by patch creation.

Figure 7A:
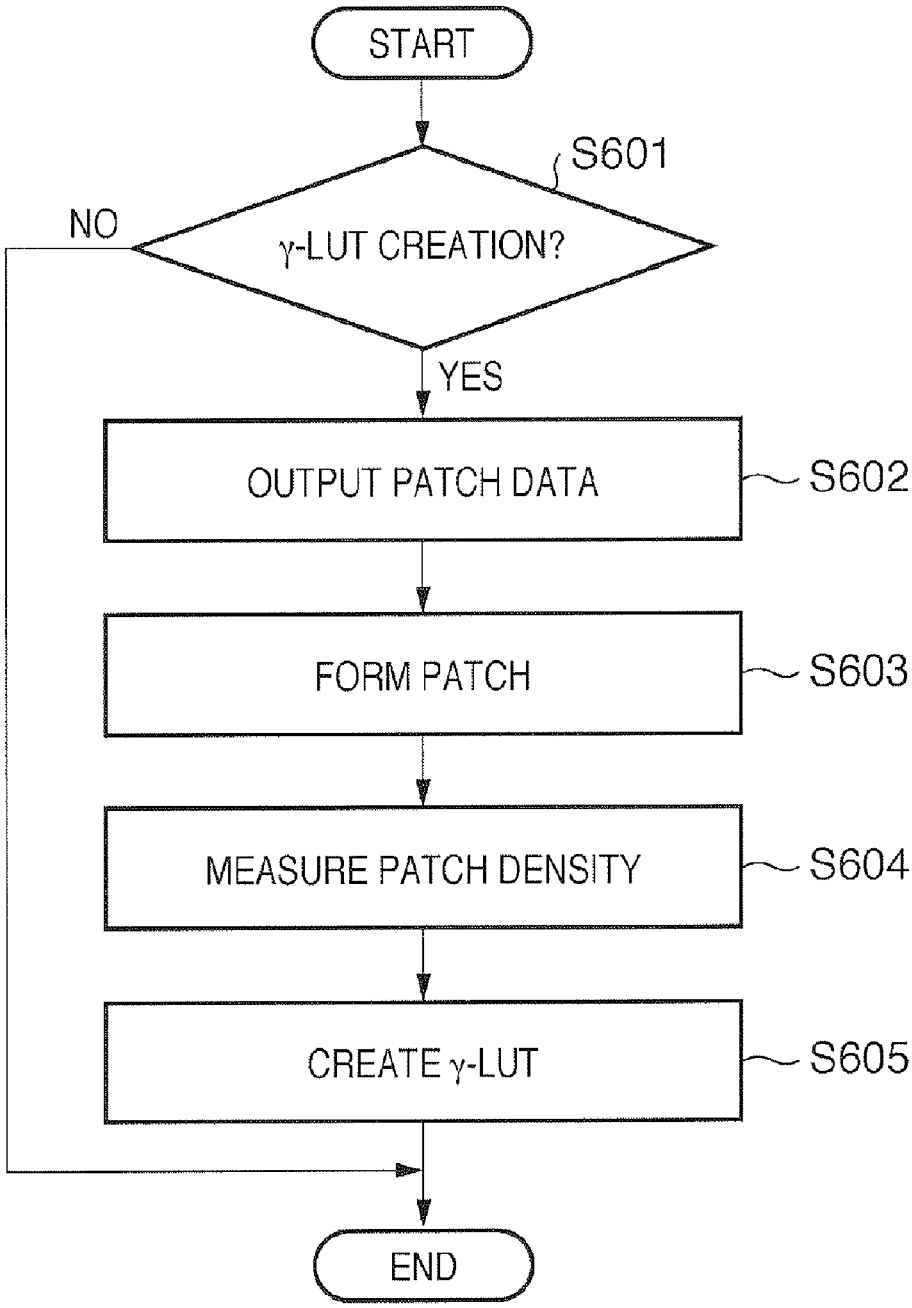
FIG. 7A is a flowchart of tone conversion processing.

Note that in this embodiment, the method shown in FIG. 7A is used as tone correction control by feedback control. However, this control may be used in combination with another feedback control of, for example, forming patches between prints and controlling the tone characteristic based on their densities. When forming patches between prints without lowering throughput, the number of formable patches is limited. Hence, to perform tone correction control as shown in FIG. 7A, a plurality of prints is needed. Hence, tone correction control shown in FIG. 7B is necessary.

[Third Embodiment]

Figure 13A:
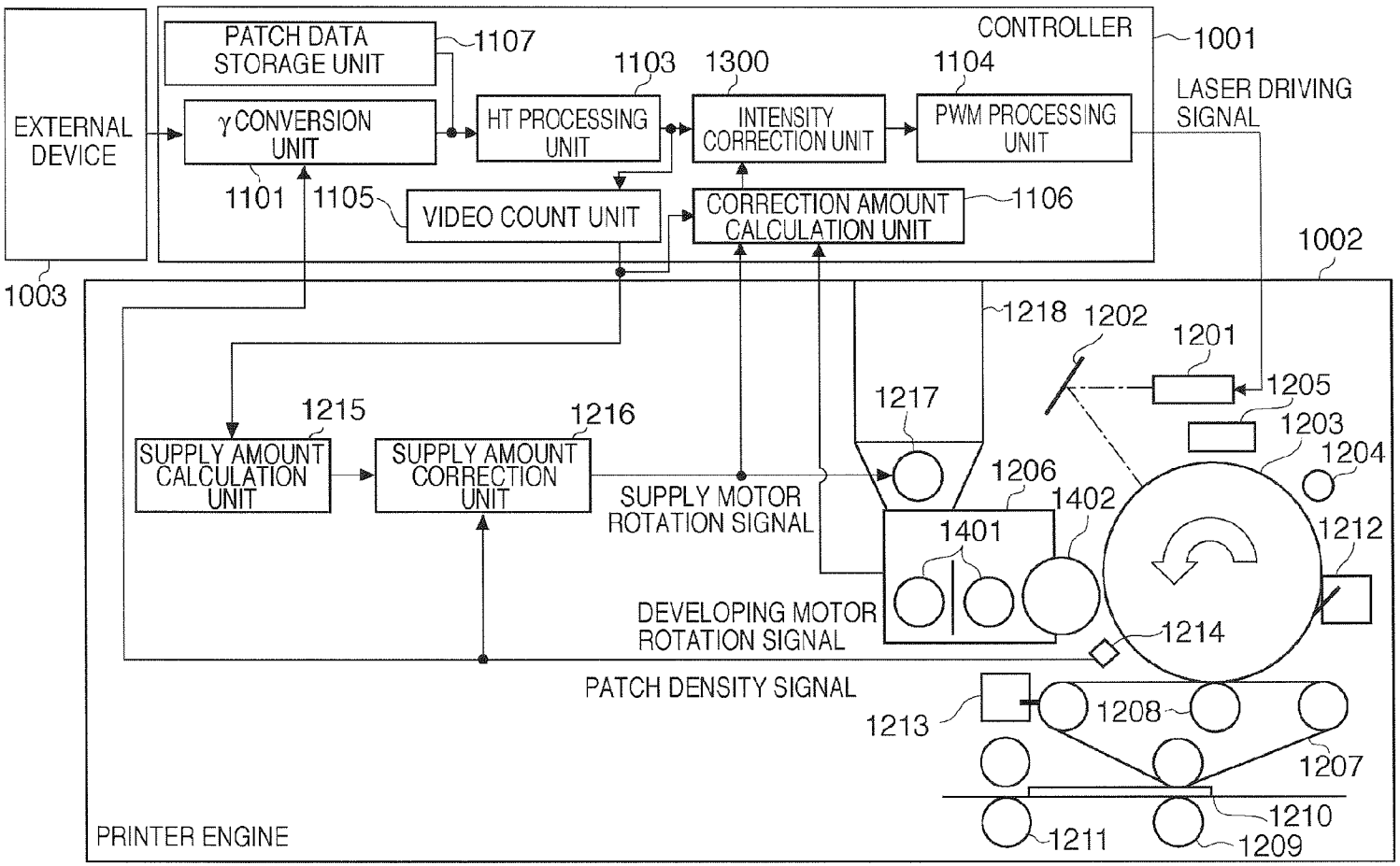
FIG. 13A is a block diagram showing the arrangement of an image forming apparatus according to the third embodiment.

In the second embodiment, the method of correcting the tone using the γ-LUT has been described. In the third embodiment, an example will be described in which the tone characteristic is corrected by correcting the laser intensity. FIG. 13A is a block diagram showing an example of the arrangement of an image forming apparatus according to the third embodiment. Note that the arrangement shown in FIG. 13A is the same as that in FIG. 5 except that the γ correction unit 1102 is removed from the arrangement in FIG. 5 and an intensity correction unit 1300 is added to the arrangement in FIG. 5. Hence, the operation of the intensity correction unit 1300 will be described below.

The intensity correction unit 1300 receives a toner weight variation ΔM for the maximum value 255 of an input image signal from a correction amount calculation unit 1106, and calculates a correction coefficient kp by $$kp=1/(1+\Delta M/M_{norm}) \quad (15)$$

where $M_{norm}$ is the target toner weight per unit area for the maximum value 255. The intensity correction unit 1300 multiplies the input signal by the correction coefficient kp and outputs the result to a PWM processing unit 1104.

With the above-described processing, the light emission intensity of a laser diode 1201 and the latent image to be formed on a photosensitive drum 1203 change. Normally, the intensity of the latent image is proportional to the weight of toner to be developed, and the toner charge amount is inversely proportional to the weight of toner to be developed. It is therefore possible to correct the change in the toner charge amount based on the intensity of the latent image. This enables to always obtain an output image having a stable grayscale characteristic.

[Modification]

In the above-described embodiments, a y-LUT is created. However, any other correction condition such as a coefficient may be created. For example, a multi-dimensional function that implements the characteristic in FIG. 6A may be calculated in FIG. 7A of the second embodiment. A coefficient that implements the characteristic in FIG. 6B may be calculated in FIG. 7B.

Figure 13B:
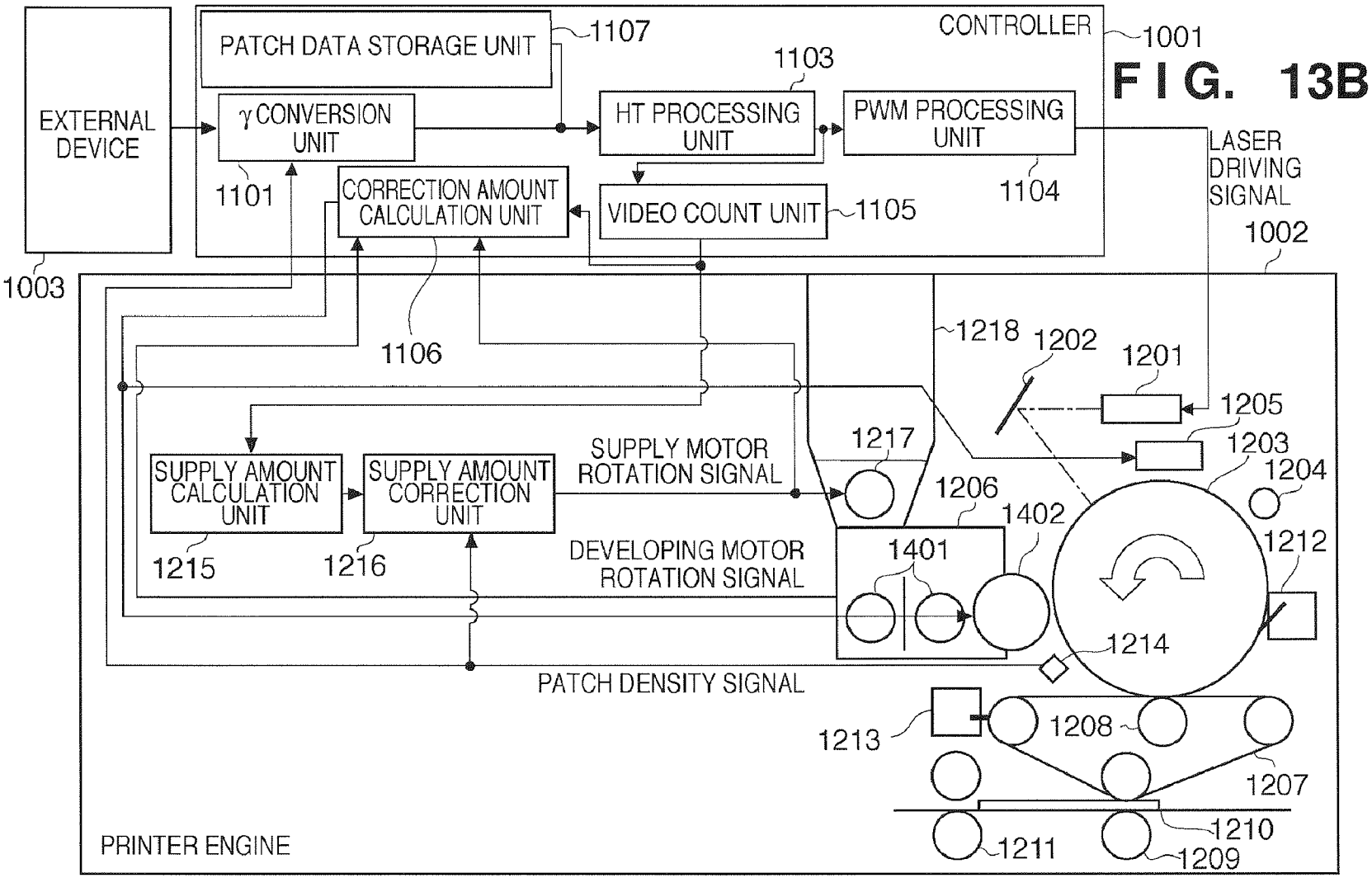
FIG. 13B is a block diagram showing the arrangement of an image forming apparatus according to the third embodiment.

In the above embodiments, an example in which γ correction is controlled has been described. Instead, any other image processing condition capable of controlling tone such as HT (halftone) may be controlled. Not only the image processing condition but also a process condition may be controlled based on the toner charge amount or toner weight predicted by the correction amount calculation unit 1106. For example, a desired latent image can be obtained by controlling the charger 1205 and the developing device 1206 and thus adjusting the charge amount or developing bias of the photosensitive drum 1203, as in the block diagram of FIG. 13B. More accurate control may be performed by combining the image processing condition and the process condition.

In the above-described embodiments, the toner consumption is calculated in proportion to the video count value. However, the toner consumption can also be calculated by, for example, considering the degree of concentration of the pixel values or storing the relationship between the video count value and the toner consumption in advance as an LUT. The video count value is the signal integrated value after HT processing. Instead, a signal after γ correction processing may be used.

In the above embodiments, the toner supply amount is determined based on the video count value and the patch density. However, a sensor for detecting the toner amount in the developing device may be used.

In the above-described embodiments, the toner charge amount varies in accordance with developing motor driving. However, since the toner that has been left stand for a long time without driving may be discharged, the toner charge amount may be obtained in consideration of this.

In the above-described embodiments, a state space model is used to predict the toner charge amount. Another approximation model (function model) such as a transfer function or a differential equation similar to the state space model may be used. Alternatively, a physical simulation to predict the toner charge amount or the results of experiments conducted in advance may be used. For example, when an LUT is generated using the results of experiments conducted in advance, the same processing result as described above can be obtained using the three-dimensional LUT which includes the toner charge amount, toner supply amount, and toner consumption as the inputs, and the amount of the change in the toner charge amount after the unit time as the output.

Figure 7B:
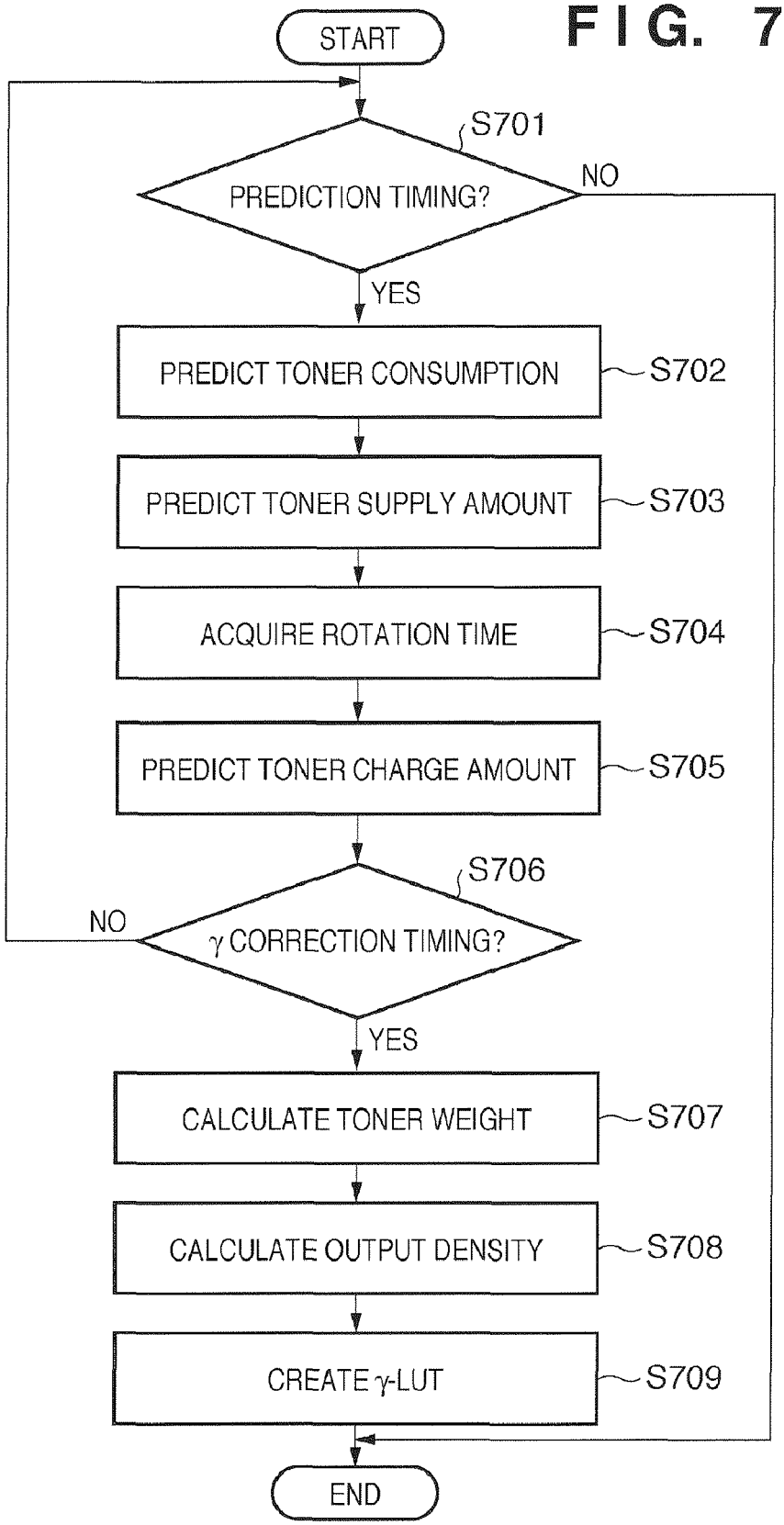
FIG. 7B is a flowchart of tone conversion processing.

In the above-described second and third embodiments, the γ-LUT creation processing according to the flowchart of FIG. 7B is executed for each print. Instead, the γ-LUT may be created at another predetermined interval such as every n estimated prints or for every predetermined image region.

The present invention is not limited to the above embodiments and various changes and modifications can be made within the spirit and scope of the present invention. Therefore, to apprise the public of the scope of the present invention, the following claims are made.

This application claims the benefit of Japanese Patent Application No. 2008-246593, filed Sep. 25, 2008 and Japanese Patent Application No. 2009-208601, filed Sep. 9, 2009, which are hereby incorporated by reference herein in their entirety.

The invention claimed is:

1. An image forming apparatus including:

an image processing unit adapted to perform image processing of an image signal using an image processing condition; and an image forming unit adapted to form an image by electrophotography using a controlled process condition based on the image signal that has undergone the image processing, comprising:

a supply unit adapted to supply toner to a developing unit based on a designated toner supply amount;

said developing unit adapted to develop an electrostatic latent image formed on a photosensitive drum after agitating the supplied toner;

a toner consumption prediction unit adapted to predict, based on image data representing an image, a toner consumption necessary for outputting the image;

a toner supply amount decision unit adapted to decide the toner supply amount based on an image signal representing the image;

an acquisition unit adapted to acquire a time of toner agitation by said developing unit; and a control unit adapted to control at least one of the image processing condition and the process condition by estimating a toner charge amount using the predicted toner consumption, the toner supply amount, and the agitation time.

2. The image forming apparatus according to claim 1, wherein said control unit predicts the toner charge amount using the predicted toner consumption, the toner supply amount, the agitation time, and a result of preceding prediction, wherein the prediction of the toner charge amount is done when said developing unit agitates the toner, and the control of the image processing condition and the process condition is done when forming an output image.

3. The image forming apparatus according to claim 1, wherein said control unit further uses a result of preceding prediction, and the predicted toner consumption, the toner supply amount, and the agitation time are change amounts from timing of the preceding prediction.

4. The image forming apparatus according to claim 1, further comprising a unit adapted to control at least one of the image processing condition and the process condition based on a measured value of a patch formed by the image forming apparatus.

5. An image forming method used by an image forming apparatus including an image processing unit which performs image processing of an image signal using an image processing condition, and an image forming unit which forms an output image by electrophotography using a controlled process condition based on the image signal that has undergone the image processing, comprising:

the supply step of supplying toner to a developing unit based on a designated toner supply amount;

the developing step of developing an electrostatic latent image formed on a photosensitive drum after agitating the supplied toner;

the toner consumption prediction step of predicting, based on image data representing an image, a toner consumption necessary for outputting the image;

the toner supply amount decision step of deciding the toner supply amount based on an image signal representing the image;

the acquisition step of acquiring a time of toner agitation by the developing unit; and the control step of controlling at least one of the image processing condition and the process condition by estimating a toner charge amount using the predicted toner consumption, the toner supply amount, and the agitation time.

* * * * *